US008004470B2

(12) United States Patent
Sorvala et al.

(10) Patent No.: US 8,004,470 B2
(45) **Date of Patent: *Aug. 23, 2011**

(54) ANTENNA, COMPONENT AND METHODS

(75) Inventors: Juha Sorvala, Oulu (FI); Petteri Annamaa, Oulunsalo (FI); Kimmo Koskiniemi, Oulu (FI)

(73) Assignee: Pulse Finland Oy, Kempele (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/871,841

(22) Filed: Aug. 30, 2010

(65) Prior Publication Data

US 2010/0321250 A1 Dec. 23, 2010

Related U.S. Application Data

(63) Continuation of application No. 11/648,429, filed on Dec. 28, 2006, now Pat. No. 7,786,938, which is a continuation of application No. PCT/FI2005/050247, filed on Jun. 28, 2005.

(30) Foreign Application Priority Data

| | | |
|---|---|---|
| Jun. 28, 2004 | (FI) | 20040892 |
| Aug. 18, 2004 | (FI) | 20041088 |
| Mar. 16, 2005 | (WO) | PCT/FI2005/050089 |

(51) Int. Cl.
*H01Q 1/24* (2006.01)

(52) U.S. Cl. ..... 343/700 MS; 343/702

(58) Field of Classification Search ..... 343/700, 343/702, 829, 846

See application file for complete search history.

(56) References Cited

U.S. PATENT DOCUMENTS

| | | | | |
|---|---|---|---|---|
| 4,069,483 | A | 1/1978 | Kaloi | |
| 4,401,988 | A * | 8/1983 | Kaloi | 343/700 MS |
| 5,001,492 | A * | 3/1991 | Shapiro et al. | 343/700 MS |

(Continued)

FOREIGN PATENT DOCUMENTS

DE 101 50 149 A1 4/2003

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waeisall @rockwellcollins.com and blhauck@rockwellcollins.com.

(Continued)

*Primary Examiner* — David G Phan
(74) *Attorney, Agent, or Firm* — Gazdzinski & Associates, PC

(57) ABSTRACT

An antenna component (and antenna) with a dielectric substrate and a plurality of radiating antenna elements on the surface of the substrate. In one embodiment, the plurality comprises two (2) elements, each of them covering one of the opposite heads and part of the upper surface of the device. The upper surface between the elements comprises a slot. The lower edge of one of the antenna elements is galvanically coupled to the antenna feed conductor on a circuit board, and at another point to the ground plane, while the lower edge of the opposite antenna element, or the parasitic element, is galvanically coupled only to the ground plane. The parasitic element obtains its feed through the electromagnetic coupling over the slot, and both elements resonate at the operating frequency. Omni-directionality is also achieved. Losses associated with the substrate are low due to the simple field image in the substrate.

23 Claims, 5 Drawing Sheets

U.S. PATENT DOCUMENTS 5,157,363 A 10/1992 Puurunen
5,278,528 A 1/1994 Turunen
5,281,326 A 1/1994 Galla
5,298,873 A 3/1994 Ala-Kojola
5,349,700 A 9/1994 Parker
5,382,959 A 1/1995 Pett et al.
RE34,898 E 4/1995 Turunen
5,408,206 A 4/1995 Turunen
5,432,489 A 7/1995 Yrjola
5,506,554 A 4/1996 Ala-Kojola
5,521,561 A 5/1996 Yrjola
5,550,519 A 8/1996 Korpela
5,557,292 A 9/1996 Nygren et al.
5,675,301 A 10/1997 Nappa
5,764,190 A 6/1998 Murch et al.
5,892,490 A 4/1999 Asakura et al.
5,903,820 A 5/1999 Hagstrom
5,926,139 A * 7/1999 Korisch ..... 343/702
6,016,130 A 1/2000 Annamaa
6,097,345 A 8/2000 Walton
6,133,879 A 10/2000 Grangeat et al.
6,140,973 A 10/2000 Annamaa
6,147,650 A 11/2000 Kawahata et al.
6,177,908 B1 1/2001 Kawahata
6,185,434 B1 2/2001 Hagstrom
6,195,049 B1 2/2001 Kim et al.
6,246,368 B1 6/2001 Deming et al.
6,252,554 B1 6/2001 Isohatala
6,268,831 B1 7/2001 Sanford
6,323,811 B1 11/2001 Tsubaki
6,326,921 B1 12/2001 Eorov et al.
6,384,785 B1 * 5/2002 Kamogawa et al. ... 343/700 MS
6,404,394 B1 6/2002 Hill
6,549,167 B1 4/2003 Yoon
6,614,400 B2 9/2003 Egorov
6,650,295 B2 11/2003 Ollikainen et al.
6,683,573 B2 1/2004 Park
6,781,545 B2 8/2004 Sung
6,847,329 B2 1/2005 Ikegaya et al.
6,876,329 B2 4/2005 Milosavlievic
6,950,066 B2 9/2005 Hendler et al.
7,042,403 B2 5/2006 Colburn et al.
7,057,560 B2 6/2006 Erkocevic
7,099,690 B2 8/2006 Milosavljevic
7,126,546 B2 10/2006 Annamaa
7,136,019 B2 11/2006 Mikkola
7,148,849 B2 12/2006 Lin
7,148,851 B2 12/2006 Takaki et al.
7,180,455 B2 2/2007 Oh et al.
7,205,942 B2 4/2007 Wang et al.
7,218,282 B2 5/2007 Humpfer et al.
7,224,313 B2 5/2007 McKinzie, III et al.
7,274,334 B2 9/2007 O'Riordan et al.
7,289,064 B2 10/2007 Cheng
7,330,153 B2 2/2008 Rentz
7,333,067 B2 2/2008 Hung et al.
7,339,528 B2 3/2008 Wang et al.
7,345,634 B2 3/2008 Ozkar et al.
7,352,326 B2 4/2008 Korva
7,358,902 B2 4/2008 Erkocevic
7,385,556 B2 6/2008 Chung et al.
7,423,592 B2 9/2008 Pros et al.
7,439,929 B2 10/2008 Ozkar
2002/0019247 A1 2/2002 Egorov
2002/0145569 A1 10/2002 Onaka
2002/0163470 A1 11/2002 Nagumo et al.
2002/0196192 A1 12/2002 Nagumo et al.
2003/0020659 A1 1/2003 Kushihi
2003/0092420 A1 5/2003 Sugimoto et al.
2003/0222827 A1 12/2003 Sung
2004/0080457 A1 4/2004 Guo et al.
2004/0090366 A1 5/2004 Wong et al.
2004/0090378 A1 5/2004 Dai et al.
2004/0090382 A1 5/2004 Kushihi et al.
2004/0130493 A1 7/2004 Horita et al.
2004/0178957 A1 9/2004 Chang et al.
2005/0024268 A1 2/2005 McKinzie, III et al.
2005/0024272 A1 2/2005 Ponce De Leon et al.
2005/0057401 A1 3/2005 Yuanzhu
2005/0078037 A1 4/2005 Leclerc et al.
2005/0110692 A1 5/2005 Andersson
2005/0243001 A1 11/2005 Miyata et al.
2006/0071857 A1 4/2006 Pelzer
2006/0145924 A1 7/2006 Chen et al.
2006/0214857 A1 9/2006 Ollikainen
2007/0013589 A1 1/2007 Park et al.
2007/0109202 A1 5/2007 Vance
2007/0115177 A1 5/2007 Kawahata et al.
2007/0139277 A1 6/2007 Nissinen
2007/0152881 A1 7/2007 Chan
2007/0152885 A1 7/2007 Sorvala
2007/0152887 A1 7/2007 Castany et al.
2007/0159399 A1 7/2007 Perunka
2007/0171131 A1 7/2007 Sorvala
2007/0241970 A1 10/2007 Thornell-Pers
2007/0268190 A1 11/2007 Huynh
2007/0290938 A1 12/2007 Loyet
2008/0007459 A1 1/2008 Koskiniemi
2008/0042903 A1 2/2008 Cheng
2008/0088511 A1 4/2008 Sorvala
2008/0204328 A1 8/2008 Nissinen
2008/0284661 A1 11/2008 He
2008/0303729 A1 12/2008 Milosavljevic
2008/0316116 A1 12/2008 Hobson et al.
2009/0135066 A1 5/2009 Raappana
2010/0176998 A1 * 7/2010 Sorvala ..... 343/702

FOREIGN PATENT DOCUMENTS

EP 0 332 139 9/1989
EP 0 376 643 A2 4/1990
EP 0 759 646 A1 2/1997
EP 0 766 341 2/1997
EP 0 766 340 4/1997
EP 0 831 547 A2 3/1998
EP 1 294 048 1/1999
EP 0 942 488 A2 9/1999
EP 1 003 240 A2 5/2000
EP 1 052 723 11/2000
EP 1 063 722 A2 12/2000
EP 1 102 348 5/2001
EP 1 113 524 7/2001
EP 1 128 466 A2 8/2001
EP 1 139 490 10/2001
EP 1 146 589 10/2001
EP 1 162 688 12/2001
EP 1 248 316 9/2002
EP 1 267 441 12/2002
EP 1 294 049 A1 3/2003
EP 1 351 334 8/2003
EP 1 361 623 11/2003
EP 1 406 345 4/2004
EP 1 414 108 4/2004
EP 1 432 072 6/2004
EP 1 437 793 7/2004
EP 1 453 137 9/2004
EP 1 469 549 10/2004
EP 1 482 592 12/2004
EP 1 498 984 1/2005
EP 1 544 943 6/2005
EP 1 791 213 5/2007
JP 7249923 9/1995
JP 10 028013 1/1998
JP 10 209733 8/1998
JP 11 004117 1/1999
JP 11 068456 3/1999
JP 11 355033 12/1999
JP 2002319811 A 10/2002
JP 2004112028 4/2004
JP 2004363859 12/2004
JP 2005005985 1/2005
JP 2005252661 9/2005
KR 10-2006-7027462 12/2002
WO WO 98/37592 8/1998
WO WO 00/36700 6/2000
WO WO 01/28035 4/2001
WO WO 01/33665 5/2001
WO WO 02/11236 A1 2/2002

| | | | |
|---|---|---|---|
| WO | WO 02/078123 | | 10/2002 |
| WO | WO 2004/070872 | | 8/2004 |
| WO | WO 2004/100313 | | 11/2004 |
| WO | WO 2004/112189 | A | 12/2004 |
| WO | WO 2005/011055 | | 2/2005 |
| WO | WO 2005/018045 | | 2/2005 |
| WO | WO 2005/038981 | A1 | 4/2005 |
| WO | WO 2005/055364 | | 6/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | A1 | 1/2007 |
| WO | WO 2007/012697 | | 2/2007 |
| WO | WO 2007/039667 | | 4/2007 |
| WO | WO 2007/039668 | | 4/2007 |
| WO | WO 2007/042615 | | 4/2007 |
| WO | WO 2007/138157 | | 12/2007 |

OTHER PUBLICATIONS

O. Kivekäs, et al.; "Frequency-tunable internal antenna for mobile phones", Proceedings of 12èmes Journées Internationales de Nice sur les Antennes, 12$^{th}$ Int'l Symposium on Antennas (JINA 2002), vol. 2, 2002, Nice, France, s.53-56, tiivistelmä.

Wong, K., et al.; "A Low-Profile Planar Monopole Antenna for Multiband Operation of Mobile Handsets"; IEEE Transactions on Antennas and Propagation, Jan. '03, vol. 51, No. 1.

Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.

Wang, H.; "Dual-Resonance Monopole Antenna with Tuning Stubs"; IEEE Proceedings, Microwaves, Antennas & Propagation, vol. 153, No. 4, Aug. 2006; pp. 395-399.

* cited by examiner

ANTENNA, COMPONENT AND METHODS

PRIORITY AND RELATED APPLICATIONS

This application is a continuation of, and claims priority to, U.S. patent application Ser. No. 11/648,429 filed Dec. 28, 2006 and entitled "Antenna Component and Methods" which is a continuation of and claims priority to International PCT Application No. PCT/FI2005/050247 having an international filing date of Jun. 28, 2005, which claims priority to Finland Patent Application No. 20040892 filed Jun. 28, 2004, and also to Finland Patent Application No. 20041088 filed Aug. 18, 2004, each of the foregoing incorporated herein by reference in its entirety. This application also claims priority to PCT Application No. PCT/FI2005/050089 having an international filing date of Mar. 16, 2005, also incorporated herein by reference in its entirety.

This application is related to co-owned U.S. patent application Ser. No. 11/544,173 filed Oct. 5, 2006 and entitled "Multi-Band Antenna With a Common Resonant Feed Structure and Methods" (now U.S. Pat. No. 7,589,678), and co-owned U.S. patent application Ser. No. 11/603,511 filed Nov. 22, 2006 and entitled "Multiband Antenna Apparatus and Methods" (now U.S. Pat. No. 7,663,551), each also incorporated herein by reference in its entirety. This application is also related to co-owned U.S. patent application Ser. No. 11/648,431 filed Dec. 28, 2006 and entitled "Chip Antenna Apparatus and Methods" (now U.S. Pat. No. 7,679,565), also incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to antennas for radiating and/or receiving electro-magnetic energy, and specifically in one aspect to a component, where conductive coatings of a dielectric substrate function as radiators of an antenna. The invention also relates to an antenna made by using such a component.

2. Description of Related Technology

In small-sized radio devices, such as mobile phones, the antenna or antennas are preferably placed inside the cover of the device, and naturally the intention is to make them as small as possible. An internal antenna has usually a planar structure so that it includes a radiating plane and a ground plane below it. There is also a variation of the monopole antenna, in which the ground plane is not below the radiating plane but farther on the side. In both cases, the size of the antenna can be reduced by manufacturing the radiating plane on the surface of a dielectric chip instead of making it air insulated. The higher the dielectricity of the material, the smaller the physical size of an antenna element of a certain electric size. The antenna component becomes a chip to be mounted on a circuit board. However, such a reduction of the size of the antenna entails the increase of losses and thus a deterioration of efficiency.

FIG. 1 shows an antenna component known from the publications EP 1 162 688 and U.S. Pat. No. 6,323,811, in which component there are two radiating elements side by side on the upper surface of the dielectric substrate 110. The first element 120 is connected by the feed conductor 141 to the feeding source, and the second element 130, which is a parasitic element, by a ground conductor 143 to the ground. The resonance frequencies of the elements can be arranged to be a little different in order to widen the band. The feed conductor and the ground conductor are on a lateral surface of the dielectric substrate. On the same lateral surface, there is a matching conductor 142 branching from the feed conductor 141, which matching conductor is connected to the ground at one end. The matching conductor extends so close to the ground conductor 143 of the parasitic element that there is a significant coupling between them. The parasitic element 130 is electromagnetically fed through this coupling. The feed conductor, the matching conductor and the ground conductor of the parasitic element together form a feed circuit; the optimum matching and gain for the antenna can then be found by shaping the strip conductors of the feed circuit. Between the radiating elements, there is a slot 150 running diagonally across the upper surface of the substrate, and at the open ends of the elements, i.e. at the opposite ends as viewed from the feeding side, there are extensions reaching to the lateral surface of the substrate. By means of such design, as well by the structure of the feed circuit, it is aimed to arrange the currents of the elements to be orthogonal so that the resonances of the elements would not weaken each other.

A drawback of the above described antenna structure is that in spite of the optimization of the feed circuit, waveforms that increase the losses and are useless with regard to the radiation are created in the dielectric substrate. The efficiency of the antenna is thus not satisfactory. In addition, the antenna leaves room for improvement if a relatively even radiation pattern, or omnidirectional radiation, is required.

SUMMARY OF THE INVENTION

The present invention addresses the foregoing needs by disclosing antenna component apparatus and methods.

In a first aspect of the invention, an antenna is disclosed. In one embodiment, the antenna comprises: a dielectric substrate comprising a plurality of surfaces, a first antenna element disposed at least partially on a first surface of the substrate and at least partially on a second surface of the substrate, the first antenna element adapted to be coupled to a feed structure at a first location and to a ground plane at a second location, and a second antenna element disposed at least partially on a third surface of the substrate, the third surface substantially opposing the first surface, and at least partially on the second surface. In one variant, the second antenna element is adapted to couple to the ground plane at least at a third location, and the apparatus further comprises an electromagnetic coupling element disposed substantially between the first element and the second element, and configured to electromagnetically couple the second antenna to the first antenna element so as to form a resonant structure between the first antenna element, the second antenna element, the dielectric substrate, and the ground plane.

In another variant, the second antenna element is adapted to be coupled to the ground plane at a fourth location, the third location and the second location are positioned distally relative to the electromagnetic coupling element, the first and the second location are disposed proximate an edge of the first surface. The third location is disposed proximate an edge of the third surface.

In a further variant, the electromagnetic coupling element comprises a linear slot disposed on the second surface and the substrate comprises a substantially rectangular shape. The linear slot is disposed substantially diagonally on the second surface running from one corner of the rectangle to an opposing corner of the rectangle.

In yet another variant, the feed structure coupled to the first antenna element comprises a conductive material asymmetrically coupled proximate a first corner of the dielectric substrate so as to effect a substantially omni-directional radiation pattern within at least a first frequency range. The ground plane is disposed a first predetermined distance away from the dielectric substrate along at least a portion of a fourth surface of the dielectric substrate, and the ground plane is further disposed a second predetermined distance away from the dielectric substrate along at least a portion of a fifth surface of the dielectric substrate, the fifth surface substantially opposing the fourth surface.

In another embodiment, the antenna comprises a dielectric means comprising a plurality of surfaces, a first antenna element disposed at least partially on a first surface of the dielectric means and at least partially on a second surface of the dielectric means, the first antenna element adapted to be coupled to a feed means at a first location and to a ground means at a second location, a second antenna element disposed at least partially on a third surface of the dielectric means, the third surface substantially opposing first surface, and at least partially on the second surface. The second antenna element is adapted to couple to the ground means at least at a third location, and means for electromagnetic coupling electrically disposed substantially between the first element and the second element, and configured to electromagnetically couple the second antenna to the first antenna element so as to form a resonant structure between the first antenna element, the second antenna element, the dielectric means, and the ground means.

In a second aspect of the invention, a radio frequency device adapted for wireless communications is disclosed. In one embodiment, the radio frequency device comprises a printed circuit board comprising a ground plane and an antenna assembly for enabling at least a portion of the wireless communications.

In one variant, the antenna assembly comprises: a dielectric substrate comprising a plurality of surfaces, a first antenna element disposed at least partially on a first surface of the substrate and at least partially on a second surface of the substrate, the first antenna element coupled to the ground plane at a second location, a second antenna element disposed at least partially on a third surface of the substrate, the third surface located substantially opposing the first surface, and at least partially on the second surface, the second antenna element coupled to the ground plane at least at a third location, an electromagnetic coupling element disposed at least partly between the first antenna element and the second antenna element. The assembly further comprises a feed structure galvanically coupled to the first antenna element at a first location and coupled to the second antenna element through the electromagnetic coupling element so as to form a resonant structure between the first antenna element, the second antenna element, the dielectric substrate, and a ground plane. The ground plane is arranged a first predetermined distance away from the first antenna element and the second antenna element along at least a portion of a fourth surface of the dielectric substrate.

In another variant, the ground plane is further arranged a second predetermined distance away from the first antenna element and the second antenna element along at least a portion of the first surface and along at least a portion of the third surface of the dielectric substrate.

In yet another variant, the ground plane is arranged a third predetermined distance away from the first antenna element and the second antenna element along at least a portion of a fifth surface of the dielectric substrate, the fifth surface substantially opposing the fourth surface.

In still another variant, the electromagnetic coupling element comprises a substantially linear slot disposed substantially diagonally on the second surface, such that the third location and the second location are positioned distally relative to the slot.

In yet another variant, the radio frequency device comprises a mobile phone, and the printed circuit board is disposed within an exterior cover of the phone. A resonance of the resonant structure is formed at a frequency of approximately 2.4 GHz and the antenna component is approximately 2 mm×2 mm×7 mm in size.

In a further variant, a resonance of the resonant structure is formed at a frequency of approximately 1575 MHz and the dielectric substrate is approximately 2 mm×3 mm×10 mm in size.

In a third aspect of the invention, an antenna is disclosed. In one embodiment, the antenna comprises: a dielectric means comprising a plurality of surfaces; a first antenna element; a second antenna element; and means for electromagnetic coupling electrically disposed substantially between the first element and the second element.

In one variant, the first element is disposed at least partially on a first surface of the dielectric means and at least partially on a second surface of the dielectric means, and the first antenna element is adapted to be coupled to a feed means at a first location and to a ground means at a second location.

In another variant, the second element is disposed at least partially on a third surface of the dielectric means, the third surface substantially opposing first surface, and at least partially on the second surface, and the second antenna element is adapted to couple to the ground means at least at a third location.

In yet another variant, the means for electromagnetic coupling is configured to electromagnetically couple the second antenna to the first antenna element so as to form a resonant structure between the first antenna element, the second antenna element, the dielectric means, and the ground means.

In another embodiment, the antenna component is produced by the method comprising using of a semiconductor technique; i.e., by growing a metal layer on the surface of the substrate (e.g. quartz substrate), and removing a part of it so that the elements remain.

BRIEF DESCRIPTION OF THE DRAWINGS

In the following, the invention will be described in more detail. Reference will be made to the accompanying drawings, in which.

DETAILED DESCRIPTION OF THE INVENTION

Reference is now made to the drawings wherein like numerals refer to like parts throughout.

As used herein, the terms "wireless", "radio" and "radio frequency" refer without limitation to any wireless signal, data, communication, or other interface or radiating component including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/802.15, WiMAX (802.16), 802.20, narrowband/FDMA, OFDM, PCS/DCS, analog cellular, CDPD, satellite systems, millimeter wave, or microwave systems.

Figure 2:
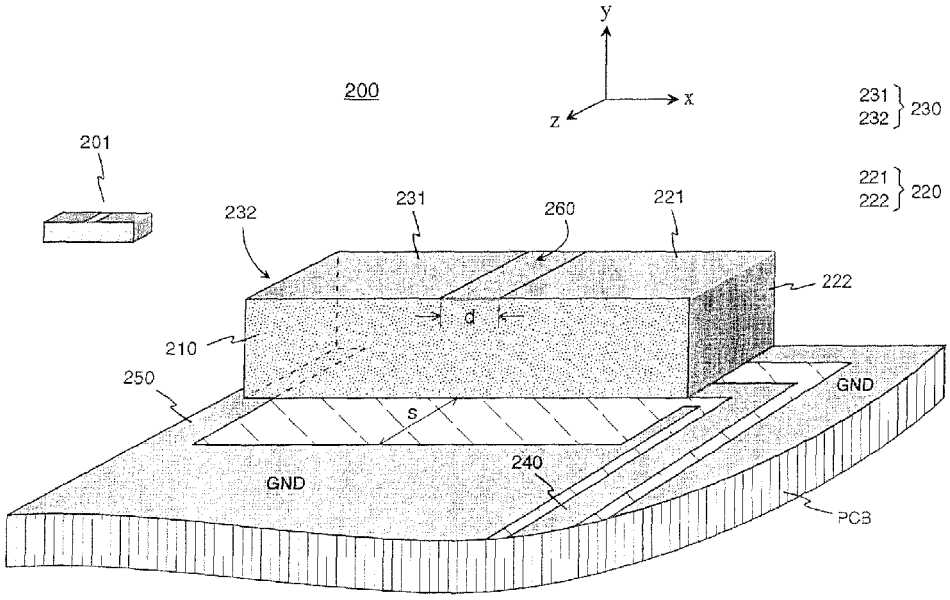
FIG. 2 presents an example of an antenna component and an antenna according to the invention.
Figure 5A:
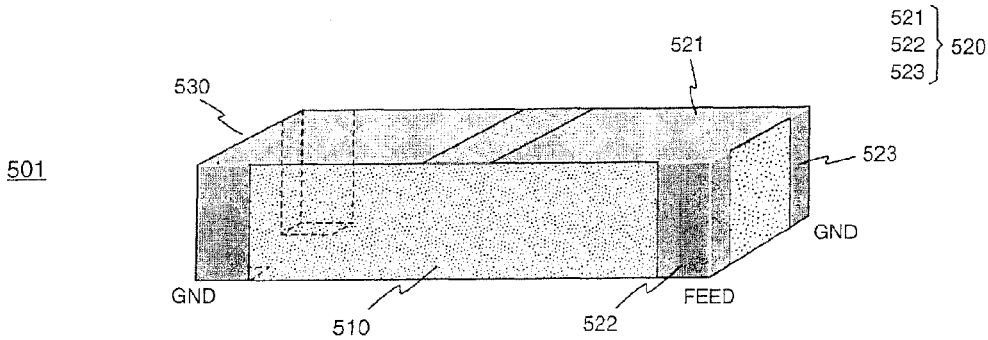
FIGS. 5*a* and 5*b* present an example of an antenna component according to the invention.

Additionally, it will be appreciated that as used herein, the qualifiers "upper" and "lower" refer to the relative position of the antenna shown in FIGS. 2 and 5*a*, and have nothing to do with the position in which the devices are used, and in no way are limiting, but rather merely for convenient reference.

Overview

In one salient aspect, the present invention comprises an antenna component (and antenna Formed therefrom) which overcomes the aforementioned deficiencies of the prior art.

Specifically, one embodiment of the invention comprises a plurality (e.g., two) radiating antenna elements on the surface of a dielectric substrate chip. Each of them substantially covers one of the opposing heads, and part of the upper surface of the chip. In the middle of the upper surface between the elements is formed a narrow slot. The lower edge of one of the antenna elements is galvanically coupled to the antenna feed conductor on the circuit board, and at another point to the ground plane, while the lower edge of the opposite antenna element, or the parasitic element, is galvanically coupled only to the ground plane. The parasitic element obtains its feed through the electromagnetic coupling over the slot, and both elements resonate with substantially equally strength at the designated operating frequency.

In one embodiment, the aforementioned component is manufactured by a semiconductor technique; e.g., by growing a metal layer on the surface of quartz or other type of substrate, and removing a part of it so that the elements remain.

The antenna component disclosed herein has as one marked advantage a very small size. This is due primarily to the high dielectricity of the substrate used, and that the slot between the antenna elements is comparatively narrow. Also, the latter fact makes the "electric" size of the elements larger.

In addition, the invention has the advantage that the efficiency of an antenna made using such a component is high, in spite of the use of the dielectric substrate. This is due to the comparatively simple structure of the antenna, which produces an uncomplicated current distribution in the antenna elements, and correspondingly a simple field image in the substrate without "superfluous" waveforms.

Moreover, the invention has an excellent omnidirectional radiation profile, which is largely due to the symmetrical structure, shaping of the ground plane, and the nature of the coupling between the elements.

A still further advantage of the invention is that both the tuning and the matching of an antenna can be carried out without discrete components; i.e., just by shaping the conductor pattern of the circuit board near the antenna component.

Description of Exemplary Embodiments

Detailed discussions of various exemplary embodiments of the invention are now provided. It will be recognized that while described in terms of particular applications (e.g., mobile devices including for example cellular telephones), materials, components, and operating parameters (e.g., frequency bands), the various aspects of the invention may be practiced with respect to literally any wireless or radio frequency application.

Figure 1:
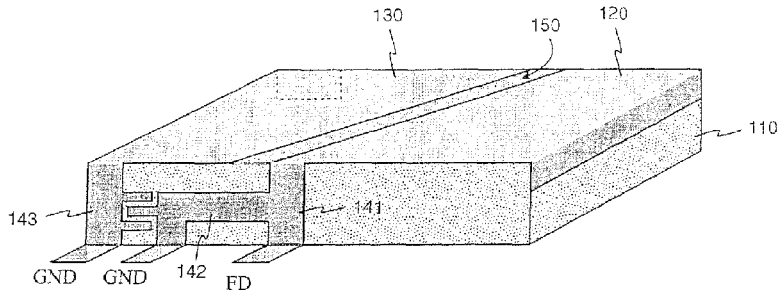
Fig. 1 PRIOR ART
FIG. 1 presents an example of a prior art antenna component.

FIG. 2 shows an example of an antenna component and a whole antenna according to the invention. The antenna component 201 comprises a dielectric substrate and plurality (two in this embodiment, although other numbers are possible) antenna elements on its surface, one of which has been connected to the feed conductor of the antenna, and the other which is an electromagnetically fed parasitic element, somewhat akin to that of the antenna of FIG. 1. However, there are several structural and functional differences between those antenna components. In the antenna component according to the present invention, among other things, the slot separating the antenna elements is between the open ends of the elements and not between the lateral edges.

Moreover, the parasitic element gets its feed through the coupling prevailing over the slot, and not through the coupling between the feed conductor and the ground conductor of the parasitic element. The first antenna element 220 of the antenna component 201 comprises a portion 221 partly covering the upper surface of an elongated, rectangular substrate 210 and a head portion 222 covering one head of the substrate. The second radiating element comprises a portion 231 symmetrically covering a part of the substrate upper surface and a head portion 232 covering the opposite head. Each head portion 222 and 232 continues slightly on the side of the lower surface of the substrate, thus forming the contact surface of the element for its connection. In the middle of the upper surface between the elements there remains a slot 260, over which the elements have an electro-magnetic coupling with each other. In the illustrated example, the slot 260 extends in the transverse direction of the substrate perpendicularly from one lateral surface of the substrate to the other, although this is by no means a requirement for practicing the invention.

In FIG. 2 the antenna component 201 is located on the circuit board PCB on its edge and its lower surface against the circuit board. The antenna feed conductor 240 is a strip conductor on the upper surface of the circuit board, and together with the ground plane, or the signal ground GND, and the circuit board material it forms a feed line having a certain impedance. The feed conductor 240 is galvanically coupled to the first antenna element 220 at a certain point of its contact surface. At another point of the contact surface, the first antenna element is galvanically coupled to the ground plane GND. At the opposite end of the substrate, the second antenna element 230 is galvanically coupled at its contact surface to the ground conductor 250, which is an extension of the wider ground plane GND. The width and length of the ground conductor 250 have a direct effect on the electric length of the second element and thereby on the natural frequency of the whole antenna. For this reason, the ground conductor can be used as a tuning element for the antenna.

The tuning of the antenna of the illustrated embodiment is also influenced by the shaping of the other parts of the ground plane, too, and the width d of the slot 260 between the antenna elements. There is no ground plane under the antenna component 201, and on the side of the component the ground plane is at a certain distance s from it. The longer the distance, the lower the natural frequency. Also reducing the slot width d lowers the antenna natural frequency. The distance s has an effect on the impedance of the antenna also. Therefore, the antenna can advantageously be matched by finding the optimum distance of the ground plane from the long side of the component. In addition, removing the ground plane from the side of the component improves the radiation characteristics of the antenna, such as its omnidirectional radiation. When the antenna component is located on the inner area of the circuit board, the ground plane is removed from its both sides.

At the operating frequency, both antenna elements together with the substrate, each other and the ground plane form a quarter-wave resonator. Due to the above-described structure, the open ends of the resonators are facing each other, separated by the slot 260, and the electromagnetic coupling is clearly capacitive. The width of the slot d can be dimensioned so that the dielectric losses of the substrate are minimized. One optimum width is, for example, 1.2 mm and a suitable range of variation 0.8-2.0 mm, for example. When a ceramic substrate is used, this structure provides a very small size. The dimensions of a component of an exemplary Bluetooth antenna operating on the frequency range 2.4 GHz are 2×2×7 $mm^3$, for example, and those of a component of a GPS (Global Positioning System) antenna operating at the frequency of 1575 MHz are 2×3×10 $mm^3$, for example. On the other hand, the slot width can be made very small, further to reduce the component size. When the slot becomes narrower, the coupling between the elements strengthens, of course, which strengthening increases their electric length and thus lowers the natural frequency of the antenna. This means that a component functioning in a certain frequency range has then to be made smaller than in the case of a wider slot.

Figure 3A:
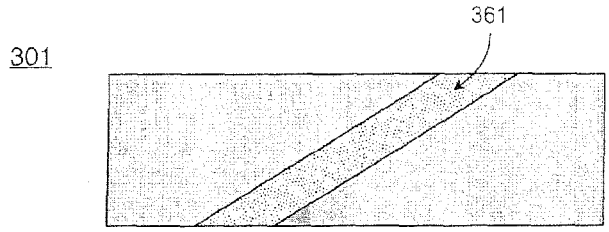
FIGS. 3*a-d* present examples of a shaping the slot between the antenna elements in the antenna component according to the invention.
Figure 3B:
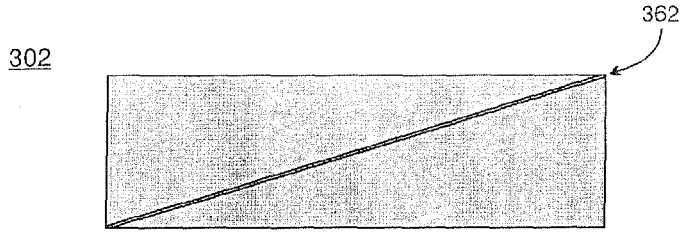

FIGS. 3*a-d* show examples of a shaping the slot between the antenna elements in the antenna component according to one embodiment of the invention. The antenna component is seen from above in each of the four drawings. In FIG. 3*a*, the slot 361 between the antenna elements of the antenna component 301 travels across the upper surface of the component, diagonally from the first side of the component to the second side. In FIG. 3*b*, the slot 362 between the antenna elements of the antenna component 302 as well travels diagonally across the upper surface of the component. The slot 362 is even more diagonal and thus longer than the slot 361, extending from a corner of the upper surface of the component to the opposite farthest corner. In addition, the slot 362 is narrower than the slot 361. Both factors have an affect, as previously explained, so that the operating band corresponding to the component 302 is located lower down than one corresponding to the component 301.

Figure 3C:
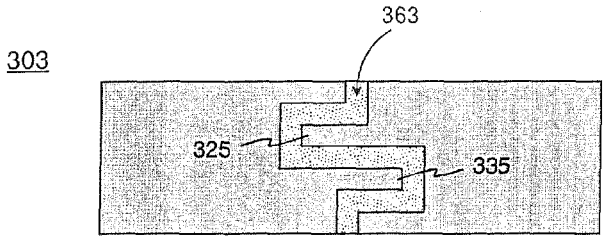
Figure 3D:
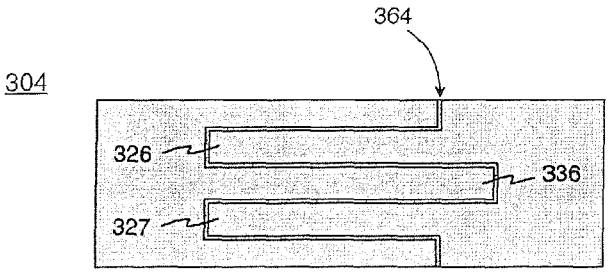

In FIG. 3*c*, the slot 363 between the antenna elements of the antenna component 303 has turns. The turns are rectangular in the illustrated embodiment, and the use of a number of them (e.g., six in this example) forms a finger-like strip 325 in the first antenna element, extending between the areas belonging to the second antenna element. Symmetrically, a finger-like strip 335 is formed in the second antenna element, extending between the areas belonging to the first antenna element. In FIG. 3*d* the slot 364 between the antenna elements of the antenna component 304 as well has turns. The number of the turns is greater than in the slot 363, so that two finger-like strips 326 and 327 are formed in the first antenna element, extending between the areas belonging to the second antenna element. Between these strips there is a finger-like strip 336 as an extension of the second antenna element. The strips in the elements of the component 304 are, besides being greater in number, also longer than the strips in the elements of the component 303, and the slot 364 is narrower than the slot 363 also. For these reasons, the operating band corresponding to the component 304 is located lower down than the operating band corresponding to the component 303.

When a very narrow slot between the antenna elements is desired, a semiconductor technique can be applied. In that case, the substrate is optimally chosen to be some basic material (e.g., wafers) used in the manufacturing process of semiconductor components, such as quartz, gallium-arsenide or silicon. A metal layer is grown on the surface of the substrate e.g. by a sputtering technique, and the layer is removed at the place of the intended slot by the exposure and etching technique well known in the manufacture of semiconductor components. This approach makes it possible to form a slot having 50 μm width, for example.

Figure 4:
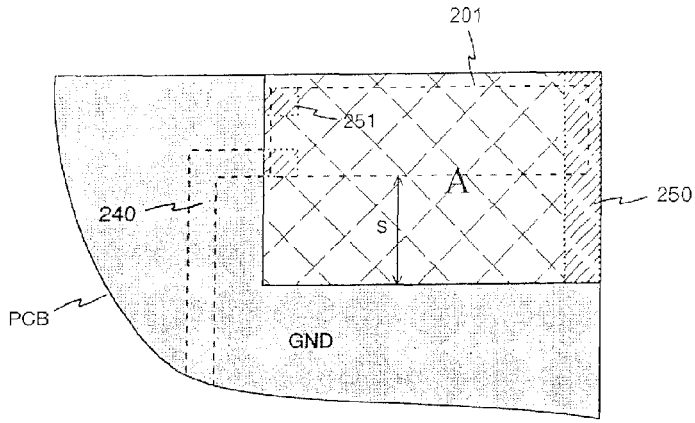
FIG. 4 presents a part of a circuit board belonging to the antenna of FIG. 2 from the reverse side.

FIG. 4 shows a part of the circuit board belonging to the antenna of FIG. 2, as seen from below. The antenna component 201 on the other side of the circuit board (e.g., PCB) has been marked with dashed lines in the drawing. Similarly with dashed lines are marked the feed conductor 240, the ground conductor 250 and a ground strip 251 extending under the component to its contact surface at the end on the side of the feed conductor. A large part of the lower surface of the circuit board belongs to the ground plane GND. The ground plane is missing from a corner of the board in the area A, which comprises the place of the component and an area extending to a certain distance s from the component, having a width which is the same as the length of the chip component.

FIG. 5*a* shows another example of the antenna component according to the invention. The component 501 is mainly similar to the component 201 presented in FIG. 2. The difference is that now the antenna elements extend to the lateral surfaces of the substrate 510 at the ends of the component, and the heads of the substrate are largely uncoated. Thus the first radiating element 520 comprises a portion 521 partly covering the upper surface of the substrate, a portion 522 in a corner of the substrate, and a portion 523 in another corner of the same end. The portions 522 and 523 in the corners are partly on the side of the lateral surface of the substrate, and partly on the side of the head surface. They continue slightly to the lower surface of the substrate, forming thus the contact surface of the element for its connection. The second antenna element 530 is similar to the first one and is located symmetrically with respect to it. The portions of the antenna elements being located in the corners can naturally also be limited only to the lateral surfaces of the substrate, or only to one of the lateral surfaces. In the latter case, the conductor coating running along the lateral surface continues at either end of the component under it for the whole length of the end.

Figure 5B:
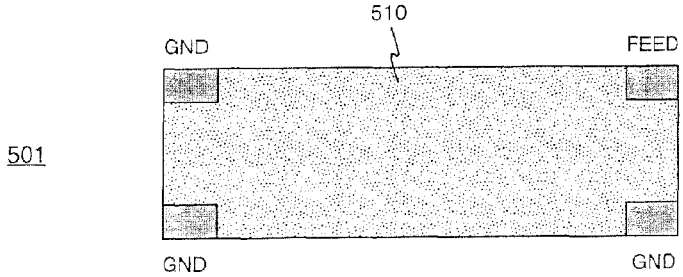

In FIG. 5*b*, the antenna component 501 of FIG. 5*a* is seen from below. The lower surface of the substrate 510 and the conductor pads serving as the contact surfaces in its corners are seen in the drawing. One of the conductor pads at the first end of the substrate is intended to be connected to the antenna feed conductor of the antenna and the other one to the ground plane GND. Both of the conductor pads at the second end of the substrate are intended to be coupled to the ground plane.

Figure 6:
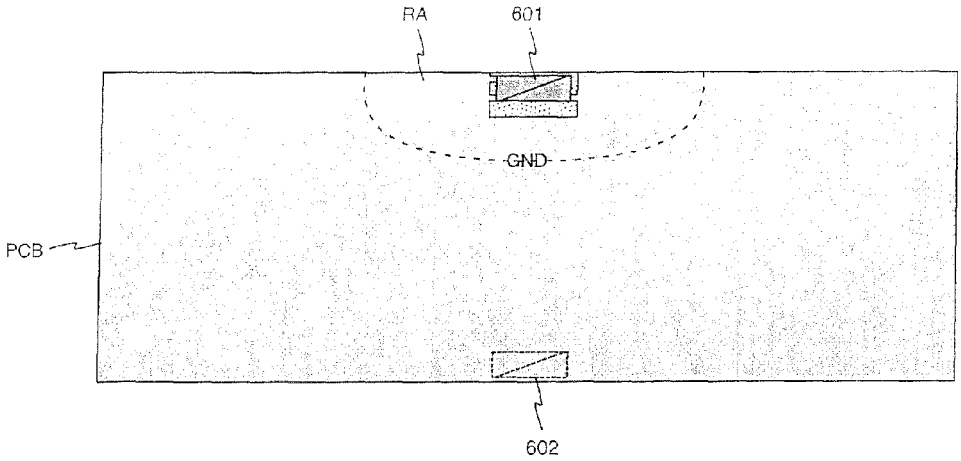
FIG. 6 presents an application of an antenna component according to the invention.

FIG. 6 shows an exemplary application of an antenna component according to the invention. In the drawing, an elongated antenna component 601 has been placed to the middle of one long side of the radio device circuit board PCB, in the direction of the circuit board. The antenna component is designed so that when it is fed, an oscillation is excited in the ground plane GND, the frequency of the oscillation being the same as the one of the feeding signal. In that case, the ground plane also functions as a useful radiator. A certain area RA round the antenna component radiates to significant degree. The antenna structure can comprise also several antenna components, as the component 602 drawn with dashed line in the Figure.

Figure 7:
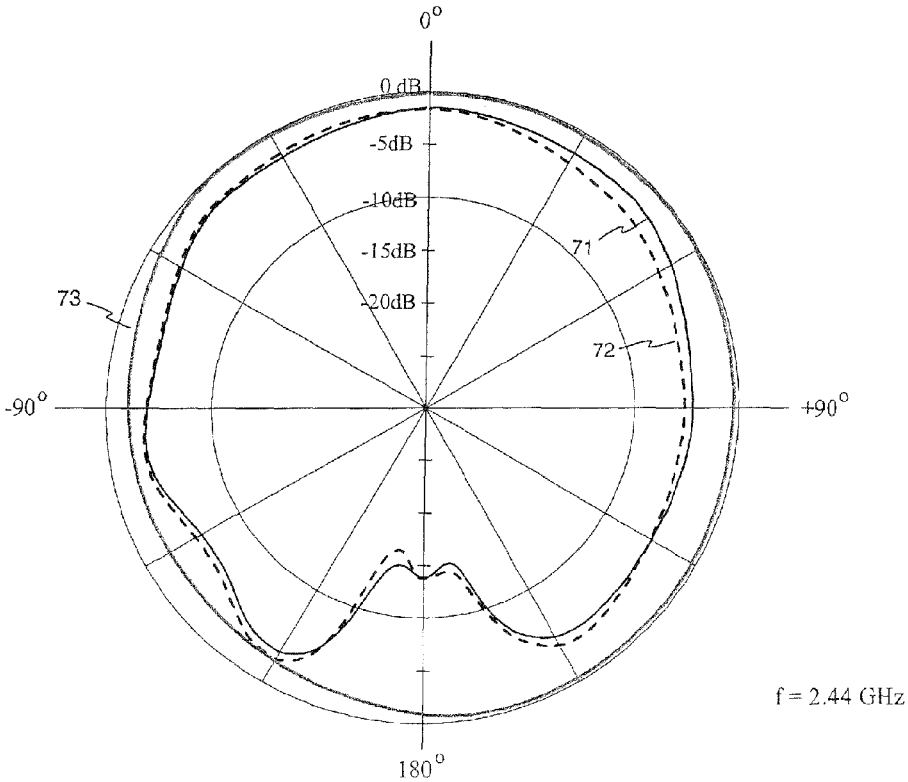
FIG. 7 presents an example of the directional characteristics of an antenna according to the invention, placed in a mobile phone.

FIG. 7 shows an example of the directional characteristics of an antenna according to one embodiment of the invention, being located in a mobile phone. The antenna has been designed for the Bluetooth system, although it will be recognized that the invention may be used in other wireless applications. There are three directional patterns in the Figure: (i) the directional pattern 71 presents the antenna gain on plane XZ, (ii) the directional pattern 72 on plane YZ, and (iii) the directional pattern 73 on plane XY; wherein the X axis is the longitudinal direction of the chip component, the Y axis is the vertical direction of the chip component, and the Z axis is the transverse direction of the chip component. It is seen from the patterns that the antenna transmits and receives well on all planes and in all directions. On the plane XY in particular, the pattern is especially even. The two others only have a recess of 10 dB in a sector about 45 degrees wide. The completely "dark" sectors typical in directional patterns do not exist at all.

Figure 8:
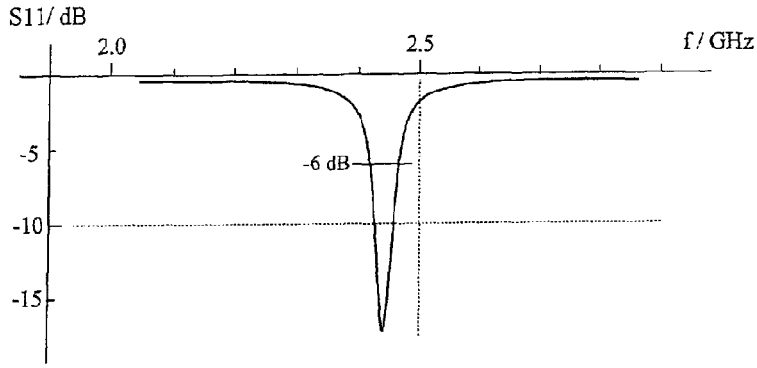
FIG. 8 shows an example of the matching of an antenna according to the invention.

FIG. 8 shows an example of the matching of an antenna according to the invention. It presents a curve of the reflection coefficient S11 as a function of frequency. The curve of FIG. 8 has been measured from the same Bluetooth antenna as the patterns of FIG. 7. If the criterion for the cut-off frequency used is the value −6 dB of the reflection coefficient, the bandwidth becomes about 50 MHz, which is about 2% as a relative value. In the center of the operating band, at the frequency of 2440 MHz, the reflection coefficient is −17 dB, which indicates good matching. The Smith diagram shows that in the center of the band, the impedance of the antenna is purely resistive, slightly inductive below the center frequency, and slightly capacitive above the center frequency, respectively.

Figure 9:
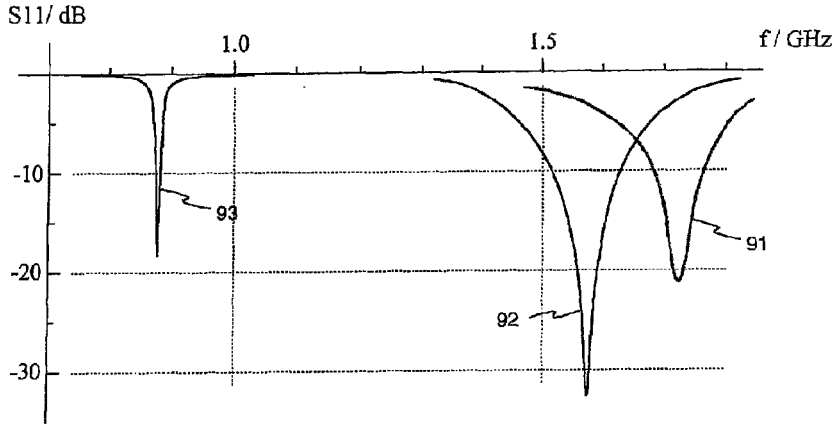
FIG. 9 shows an example of the influence of the shape of the slot between the antenna elements on the location of an antenna operating band.

FIG. 9 shows an example of the influence of the shape of the slot between the antenna elements on the location of an antenna operating band. The curve 91 shows the fluctuation of the reflection coefficient S11 as a function of frequency of an antenna comprising the antenna component, which has the size 10×3×4 $mm^3$ and a perpendicular slot between the antenna elements. The resonance frequency of the antenna, which is approximately the center frequency of the operating band, falls on the paint at 1725 MHz.

The curve 92 shows the fluctuation of the reflection coefficient, when slot between the antenna elements is diagonal according to FIG. 3*b*. In other respects, the antenna is similar to that in the previous case. Now the resonance frequency of the antenna falls on the point 1575 MHz, the operating band thus being located 150 MHz lower than in the previous case. The exemplary frequency of 1575 MHz is used by the GPS (Global Positioning System). Using a diagonal slot, not much lower frequency can be achieved by the antenna in question, in practice.

The curve 93 shows the fluctuation of the reflection coefficient, when slot between the antenna elements is devious according to FIG. 3*d* and some narrower than in two previous cases. In other respects the antenna is similar. The antenna operating band is now located nearly half lower down than in the case corresponding to the curve 91. The resonance frequency falls on the point 880 MHz, which is in the range used by the EGSM-system (Extended GSM).

In the three cases of FIG. 9, a ceram having a value of 20 for the relative dielectric constant $\in_r$ is used in the antenna. If a ceram having higher $\in_r$-value will be used, the band of an antenna with a diagonal slot can be placed, e.g. in the range of 900 MHz, without making the antenna bigger. However, the electric characteristics of the antenna would then be somewhat reduced.

Figure 10:
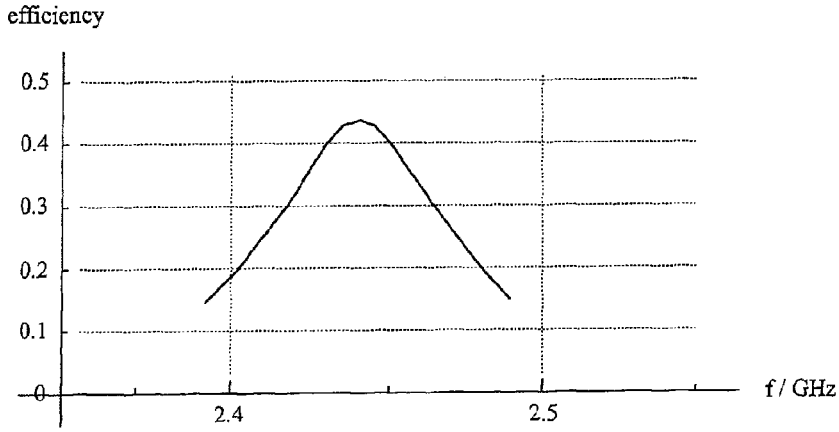
FIG. 10 presents an example of the efficiency of an antenna according to the invention.

FIG. 10 shows the efficiency of an exemplary antenna according to the invention. The efficiency has been measured from the same Bluetooth antenna as the patterns of FIGS. 7 and 8. At the center of the operating band of the antenna the efficiency is about 0.44, and decreases from that to the value of about 0.3 when moving 25 MHz to the side from the center of the band. The efficiency is considerably high for an antenna using a dielectric substrate.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna comprising:

a dielectric substrate comprising a plurality of surfaces;

a first antenna element disposed at least partially on a first surface of said substrate and at least partially on a second surface of said substrate, the first antenna element adapted to be coupled to a feed structure at a first location and to a ground plane at a second location;

a second antenna element disposed at least partially on a third surface of said substrate, the third surface substantially opposing the first surface, and at least partially on the second surface, the second antenna element adapted to couple to the ground plane at least at a third location; and an electromagnetic coupling element disposed substantially between the first element and the second element, and configured to electromagnetically couple the second antenna to the first antenna element so as to form a resonant structure between the first antenna element, the second antenna element, the dielectric substrate, and the ground plane.

2. The antenna of claim 1, wherein the second antenna element is further adapted to be coupled to the ground plane at a fourth location.

3. The antenna of claim 1, wherein the third location and the second location are positioned distally relative to the electromagnetic coupling element.

4. The antenna of claim 3, wherein the first and the second location are disposed proximate an edge of the first surface, and the third location is disposed proximate an edge of the third surface.

5. The antenna of claim 1, wherein the electromagnetic coupling element comprises a linear slot disposed on the second surface.

6. The antenna of claim 5, wherein the substrate comprises a substantially rectangular shape, and said linear slot is disposed substantially diagonally on the second surface running from one corner of said rectangle to an opposing corner of said rectangle.

7. The antenna of claim 1, wherein the feed structure coupled to the first antenna element comprises a conductive material asymmetrically coupled proximate a first corner of the dielectric substrate so as to effect a substantially omni-directional radiation pattern within at least a first frequency range.

8. The antenna apparatus of claim 1, wherein the ground plane is disposed a first predetermined distance away from the dielectric substrate along at least a portion of a fourth surface of the dielectric substrate.

9. The antenna apparatus of claim 8, wherein the ground plane is further disposed a second predetermined distance away from the dielectric substrate along at least a portion of a fifth surface of the dielectric substrate, said fifth surface substantially opposing said fourth surface.

10. The antenna apparatus of claim 8, wherein the ground plane is further disposed a third predetermined distance away from the dielectric substrate along at least a portion of the first surface and along at least a portion of the third surface.

11. A radio frequency device adapted for wireless communications, the radio frequency device comprising:

a printed circuit board comprising a ground plane and an antenna assembly for enabling at least a portion of the wireless communications, the antenna assembly comprising:

a dielectric substrate comprising a plurality of surfaces;

a first antenna element disposed at least partially on a first surface of said substrate and at least partially on a second surface of said substrate, the first antenna element coupled to the ground plane at a second location;

a second antenna element disposed at least partially on a third surface of said substrate, the third surface located substantially opposing the first surface, and at least partially on the second surface, the second antenna element coupled to the ground plane at least at a third location;

an electromagnetic coupling element disposed at least partly between the first antenna element and the second antenna element; and a feed structure galvanically coupled to the first antenna element at a first location and coupled to the second antenna element through the electromagnetic coupling element so as to form a resonant structure between the first antenna element, the second antenna element, the dielectric substrate, and a ground plane;

wherein the ground plane is arranged a first predetermined distance away from the first antenna element and the second antenna element along at least a portion of a fourth surface of the dielectric substrate.

12. The radio frequency device of claim 11, wherein the ground plane is further arranged a second predetermined distance away from the first antenna element and the second antenna element along at least a portion of the first surface and along at least a portion of the third surface of said dielectric substrate.

13. The radio frequency device of claim 11, wherein the ground plane is arranged a third predetermined distance away from the first antenna element and the second antenna element along at least a portion of a fifth surface of said dielectric substrate, the fifth surface substantially opposing the fourth surface.

14. The radio frequency device of claim 11, wherein said dielectric substrate is positioned proximate an edge of the ground plane.

15. The radio frequency device of claim 11, wherein the second antenna element coupled to the ground plane at a fourth location.

16. The radio frequency device of claim 11, wherein the electromagnetic coupling element comprises a substantially linear slot disposed substantially diagonally on the second surface.

17. The radio frequency device of claim 16, wherein the third location and the second location are positioned distally relative to the slot.

18. The radio frequency device of claim 11, wherein radio frequency device comprises a mobile phone, and the printed circuit board is disposed within an exterior cover of the phone.

19. The radio frequency device of claim 11, wherein a resonance of the resonant structure is formed at a frequency of approximately 2.4 GHz.

20. The radio frequency device of claim 19, wherein the antenna component is approximately 2 mm×2 mm×7 mm in size.

21. The radio frequency device of claim 11, wherein a resonance of the resonant structure is formed at a frequency of approximately 1575 MHz.

22. The radio frequency device of claim 21, wherein the dielectric substrate is approximately 2 mm×3 mm×10 mm in size.

23. An antenna comprising:

a dielectric means comprising a plurality of surfaces;

a first antenna element disposed at least partially on a first surface of said dielectric means and at least partially on a second surface of said dielectric means, the first antenna element adapted to be coupled to a feed means at a first location and to a ground means at a second location;

a second antenna element disposed at least partially on a third surface of said dielectric means, the third surface substantially opposing first surface, and at least partially on the second surface, the second antenna element adapted to couple to the ground means at least at a third location; and means for electromagnetic coupling electrically disposed substantially between the first element and the second element, and configured to electromagnetically couple the second antenna to the first antenna element so as to form a resonant structure between the first antenna element, the second antenna element, the dielectric means, and the ground means.

* * * * *